United States Patent [19]

Kuramoto

[11] Patent Number: 4,716,685

[45] Date of Patent: Jan. 5, 1988

[54] APPARATUS FOR ABRASIVELY TREATING THE SURFACES OF AUTOMOBILE BODIES

[75] Inventor: Yoshiaki Kuramoto, Tokyo, Japan

[73] Assignee: Nippon Flakt K.K., Japan

[21] Appl. No.: 895,482

[22] Filed: Aug. 11, 1986

Related U.S. Application Data

[63] Continuation-in-part of Ser. No. 635,909, Jul. 30, 1984, abandoned.

[51] Int. Cl.[4] ..... B24B 19/26

[52] U.S. Cl. ..... 51/74 R; 51/99; 51/267

[58] Field of Search ..... 51/74 R, 76 R, 78, 99, 51/110, 137, 138, 267, 165.71, 165.9, 165.92, 147; 15/21 D, 53 A, 53 AB

[56] References Cited

U.S. PATENT DOCUMENTS

| | | | |
|---|---|---|---|
| B 419,364 | 3/1976 | Fullerton | 15/53 A |
| 2,108,193 | 2/1938 | Brackett | 51/74 R |
| 2,576,887 | 11/1951 | Oberstar et al. | 51/74 R |
| 3,237,348 | 3/1966 | Block | 51/74 R |
| 3,395,495 | 8/1968 | Powanda | 51/267 X |
| 3,641,709 | 2/1972 | Gazuit | 51/99 X |
| 3,798,843 | 3/1974 | Weatherell | 51/165.9 X |
| 3,962,831 | 6/1976 | Miki | 51/78 |
| 4,194,923 | 3/1980 | Johnson | 15/53 AB X |

*Primary Examiner*—Robert P. Olszewski

[57] ABSTRACT

An apparatus for abrasively treating the surfaces of various shaped automobile bodies comprising a plurality of units disposed in spaced relation for processing different areas of the upper surfaces of each body, each unit comprising at least one rotatable brush, which is brought in contact with a particular area of the upper surfaces having various curvatures of the body and is held in position during automatic operation at a constant pressurization.

1 Claim, 23 Drawing Figures

| | | | |
|---|---|---|---|
| PH 1 | ○ | ○ | ○ |
| PH 2 | ○ | ○ | × |
| PH 3 | ○ | × | × |
| PH 4 | × | × | × |
| | SEDAN | COUPE | VAN |

APPARATUS FOR ABRASIVELY TREATING THE SURFACES OF AUTOMOBILE BODIES

RELATION BETWEEN APPLICATIONS

This is an application continuation-in-part to my application Ser. No. 635,909, filed on July 30, 1984 now abandoned.

FIELD OF THE INVENTION

The present invention relates to an apparatus used in the production of automobiles for abrasively treating the surfaces of a series of automobile bodies. Particularly, it relates to such an apparatus for wetsanding the surfaces of a series of prime coated automobile bodies.

BACKGROUND OF THE INVENTION

In the production of automobiles base or prime coated automobile bodies are wet-sanded prior to the final color coating step. An apparatus installed in such a wet-sanding line typically comprises a conveyor for conveying a series of automobile bodies and a stand equipped with a plurality of abrasive means rotatable with their axes of rotation in perpendicular to the direction of conveyance of the automobile bodies, and is designed so that the rotating abrasive means may be brought in contact with the surfaces of each automobile body as it progresses past the stand. However, the structure and mechanism, which have heretofore been adopted for bringing the abrasive means in contact with the automobile body, are limitedly successful as to following changes in cross-section of the automobile body as it progresses past the abrasive means and ensuring a constant abrasion pressure over the broadest possible areas of the surfaces of the automobile body.

In the accompanying drawings:

FIGS. 1 through 6 are to illustrate the state of the prior art. FIG. 1 schematically shows a mechanism disclosed in U.S. Pat. No. 3,237,348 to A.Block for bringing an overhead abrasive brush 1 in contact with the surface of the roof 2 of the automobile body. According to this U.S. patent the single transverse overhead abrasive brush 1 is carried by a pair of arms 3 (one of which is shown in FIG. 1) that are swung by a pair of power cylinders 4 (one of which is shown in FIG. 1) between a first upper operating position for processing the roof 2 and a second lower operating position for processing a trunk 5, and mounted on the arms 3 by pivoted bell cranks 6 (one of which is shown in FIG. 1) which may be rocked by power cylinders 7 (one of which is shown in FIG. 1) to an upper idle position. During operation the rotating brush 1 is forced against the surface of the roof 2 being processed by introducing air of a predetermined pressure into the power cylinders 7 of the bell cranks 6.

However, a transverse cross-sectional configuration of a given automobile body normally changes as it progresses past the abrasive means. FIG. 2 is a cross-sectional view of a central portion of the roof being processed, taken as indicated by the lines II—II of FIG. 1, while FIG. 3 is a similar view of a rear portion of the roof being processed, taken as indicated by the lines III—III of FIG. 1. As seen from FIGS. 2 and 3, variations of the transverse cross-sectional configuration of the body result in variations of the width of the brush in contact with the body from $W_1$ to $W_2$, and in turn result in variations of the area of the brush in contact with the body. Accordingly, even if the brush is forced against the body by a constant pressure in the cylinder 7, the abrasive pressure per unit area of the brush inevitably varies, leading to variations of the abrasion reduction in thickness. Obviously, uneven abrasion reduction in thickness of the prime coat is undesirable for obtaining a uniform final color coat.

Further, it is undesirable that there remain untreated areas as indicated by numeral 8 in FIG. 3, and an atempt to bring the brush in contact with those areas 8 by exerting a higher pressure on the brush will result in variations of the distance (radius) from the axis 9 of rotation of the brush to the face of the brush at which contacts with the surface of the automobile body between the central portions of the brush and the portions of the brush where it contacts with the areas 8, again leading to variations of the abrasion reduction in thickness.

For better accommodation to a given transverse cross-sectional configuration of the automobile body, U.S. Pat. No. 3,237,348 proposes use of abrasive brushes of various profiles such as illustrated in FIGS. 4 and 5. When an automobile body having stripes on its roof is to be processed, an overhead abrasive brush such as shown in FIG. 6 will have to be used. Each of the brushes shown in FIGS. 4–6, has different radii and thus different peripheral speeds from place to place, again leading to variations of the abrasive reduction in thickness. In addition, it would reduce the productivity to prepare a number of overhead abrasive brushes having various profiles and to install a suitable one on the machine in accordance with the particular cross-sectional configuration of the given type of the automobile body.

Thus, no special measure has been taken in the prior art regarding control of the abrasive pressure in response to changes of the transverse cross-sectional configuration of complex curvature of the roof of the automobile body, and in consequence variations of the abrasion reduction in thickness between the central and side zones longitudinally of the roof as well as between the central and front or rear portions transversely of the roof have been unavoidable, often leading to occurrence of areas insufficiently abraded and those excessively abraded or even badly impaired.

On the other hand an automobile manufacturer is manufacturing automobiles of different models and types. Since it is uneconomical to construct an abrasive apparatus for every model of the automobile bodies, one single abrasive line in the factory has to treat automobile bodies of different models. However, the prior art apparatus is not designed so that a change of the set operative positions of the overhead abrasive brush and a change of the set abrasive pressure may be effectively made immediately in response to change of the model of automobile bodies to be processed, and thus upon every change of the model of automobile bodies to be processed it has been necessary to stop the line and to re-set the operative positions of the brush 1 and the pressure of air to be maintained in the cylinder 7 so that a new series of automobile bodies of the changed model may be properly processed. Obviously, the necessity of such re-setting procedures would be disadvantageous. Even so re-set, there still remains a problem of uneven abrasion reduction in thickness, as discussed hereinabove.

Wet-standing in advance of the final color coating is an important step which substantially affects the quality of the color coat finish. Accordingly, an improved abrasive apparatus, by which the broadest possible areas of the surfaces of each of successively conveyed automobile bodies may be uniformly processed under a constant abrasive pressure with a uniform abrasion reduction in thickness, is desired in the art. Especially because of a recent tendency that automobiles of various body models, such as sedan, coupe and van, are manufactured in one automobile manufacturing factory at the same period of time and that with the same model a change of type is frequently effected within a relatively short interval of time, an improved abrasive apparatus which may cope with such changes of model and type, and ensure a uniform automatic abrasive treatment over the broadest possible areas of the surfaces of automobile bodies, is intensively desired in the art.

SUMMARY OF THE INVENTION

An object of the invention is to provide an improved abrasive apparatus especially suitable for wet-sanding a series of automobile bodies, which meets the above-mentioned requirements.

In an apparatus for abrasively treating the surfaces of a series of automobile bodies being longitudinally conveyed along a line by bringing the surfaces of each automobile body in contact with a plurality of abrasive brushes rotating with their axes of rotation perpendicular to the direction of conveyance of the automobile bodies, the improvement according to the invention comprising a plurality of abrading units for processing different areas of the upper surfaces of each automobile body successively disposed in predetermined spaced relation along the line of conveyance of the automobile bodies, each of said units comprising:

a support structure adjacent the line conveyance of the automobile bodies;

at least one cylindrical abrasive brush rotatable with its axis of rotation perpendicular to the direction of conveyance of the automobile bodies for processing a particular area of the upper surfaces of each automobile body, said brush having an effective abrasive width less than a half of the width of the upper surface of the automobile body;

an electric motor for rotating the axis of said brush;

a swing arm for rotatably mounting said brush and fixedly securing said motor;

a shaft for rotatably supporting said swing arm at such a position that said shaft can be an axis of any swing motion of the brush mounted on said swing arm;

a member for transmitting the rotating motion of said shaft around its axis to said swing arm, fixed at one end to said shaft and at the other end to said swing arm and having a double acting piston means interposed between said ends;

a brake motor for rotating said shaft and braking the rotation of said shaft;

a means for displacing the piston of said double action piston means so that said brush may be forced against the surface of the automobile body to be processed without rotation of hereinafter said brake means when said brush has come in contact with said surface, and for maintaining the pressure differential so established in said double acting piston means during the processing of said surface;

a clutch means interposed between said brake motor and said shaft;

a brake means for braking the rotation of said shaft only for a moment when said brush has come in contact with a surface of the automobile body to be processed; and an encoder connected to said shaft for detecting the amount of rotation of said shaft and dispatching the detected signal for automatic control of the operation of at least said brake motor and double acting piston means.

BRIEF EXPLANATION OF DRAWINGS FOR ILLUSTRATING THE INVENTION

Figure 21:
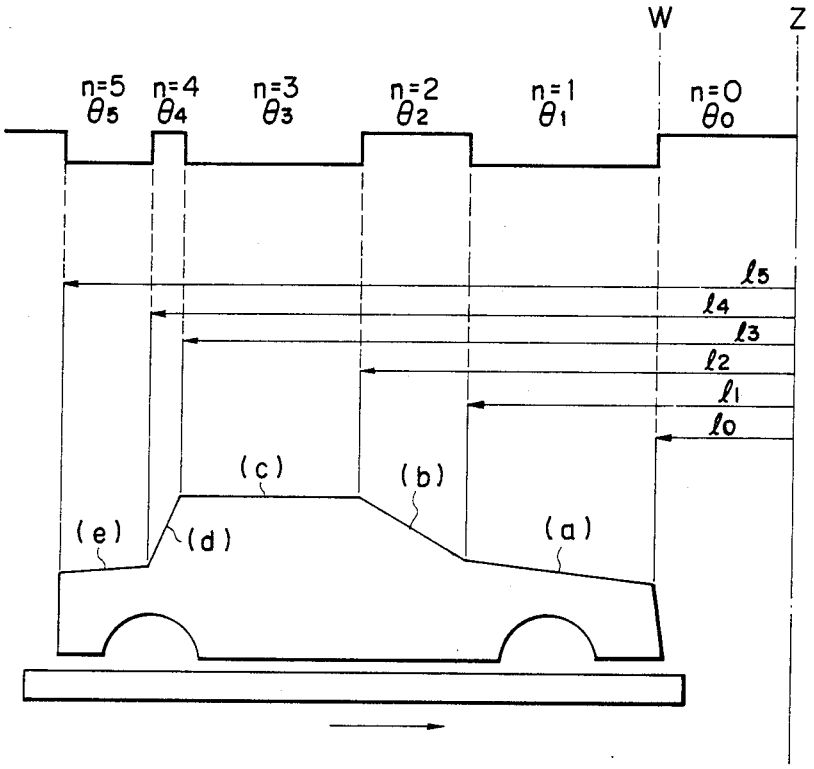
Figure 22A:
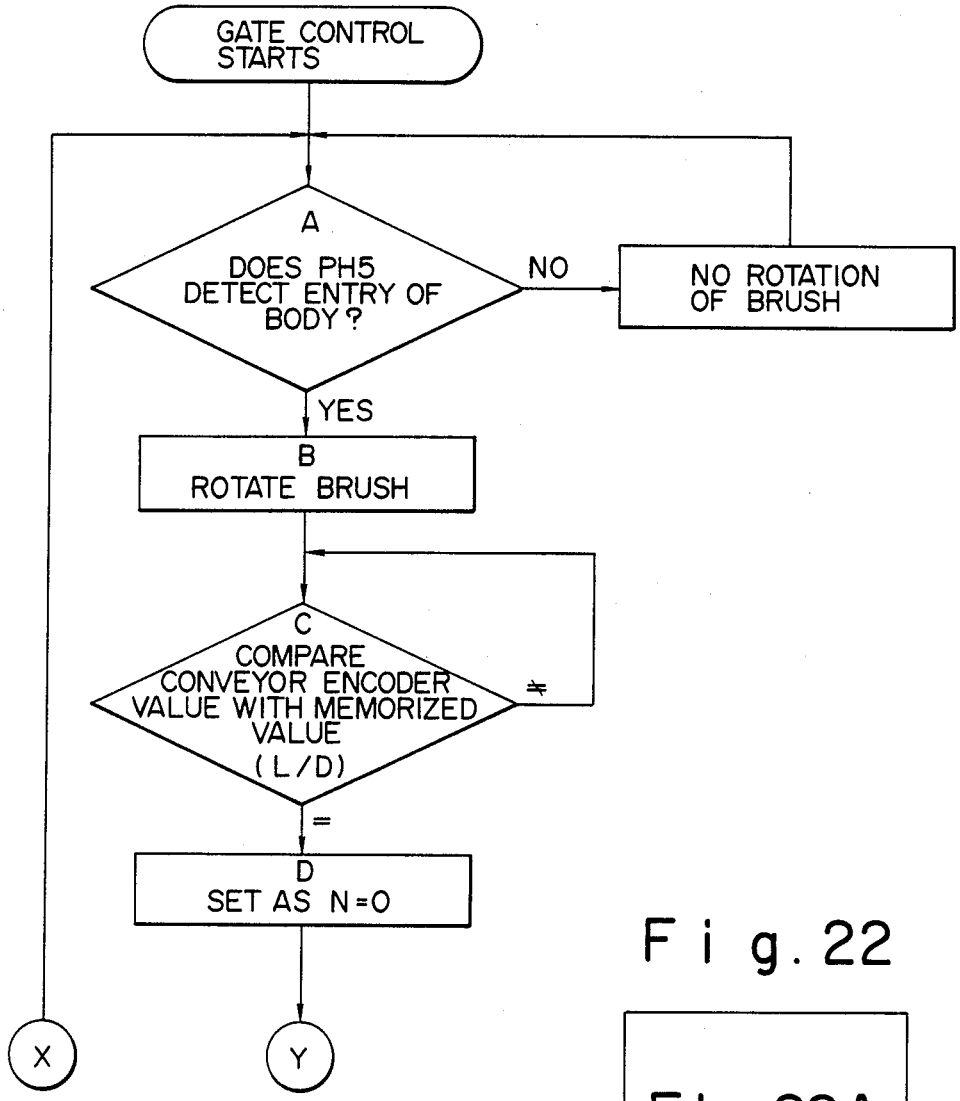
Figure 22:
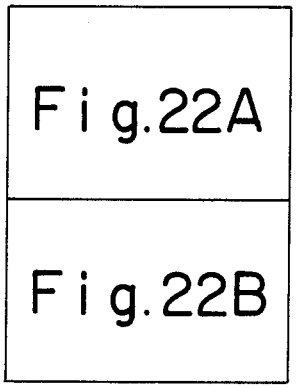
Figure 22B:
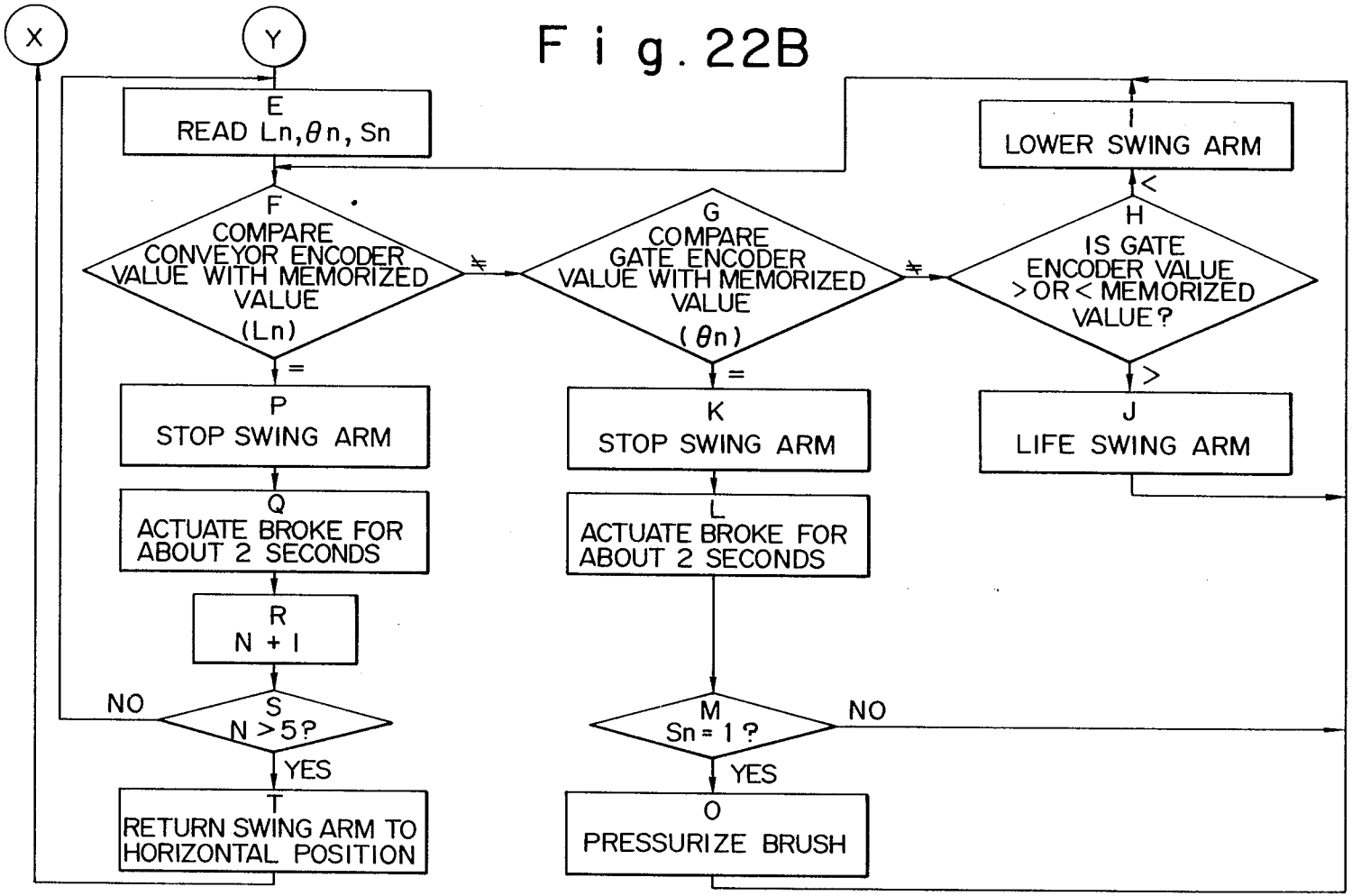

FIG. 21 a schematic side view of an automobile body, which is about to enter the gate, for showing data or physical values on said body which have to be previously memorized in a controlling computer; and FIGS. 22*a* and 22*b* show an example of a flow of automatic control at one gate.

DESCRIPTION OF PREFERRED EMBODIMENT

Figure 1:
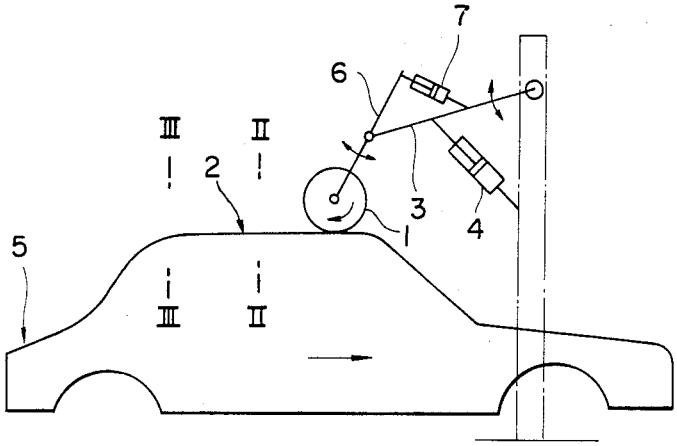
FIG. 1 is an elevational view of an automobile being abrasively treated by the apparatus of the present invention.
Figure 2:
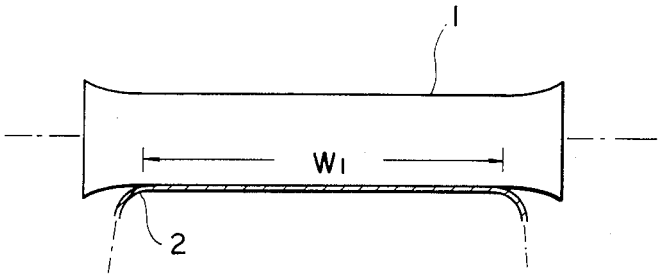
FIG. 2 is a cross-sectional view of the roof of the automobile of FIG. 1 taken along lines II—II and FIG. 1.
Figure 3:
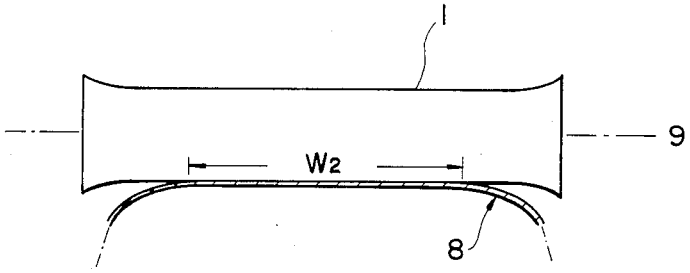
FIG. 3 is a cross-sectional view of the rear portion of the automobile of FIG. 1 as taken along the lines III—III of FIG. 1.
Figure 4:
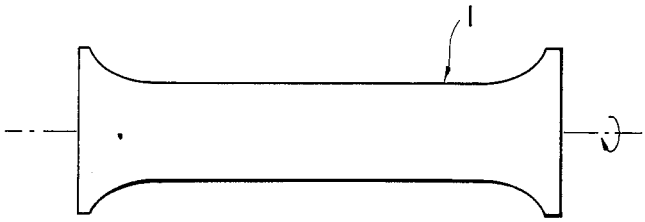
FIG. 4 is a profile of an abrasive brush which could be used with the apparatus of the present invention.
Figure 5:
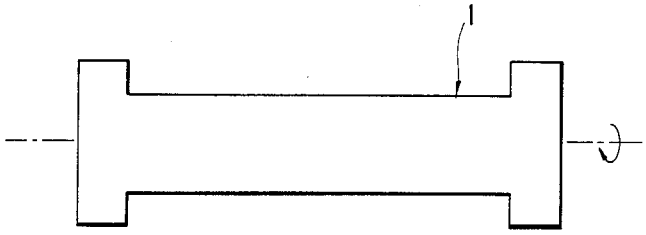
FIG. 5 is a profile of still another abrasive brush which could be used with the apparatus of the present invention.
Figure 6:
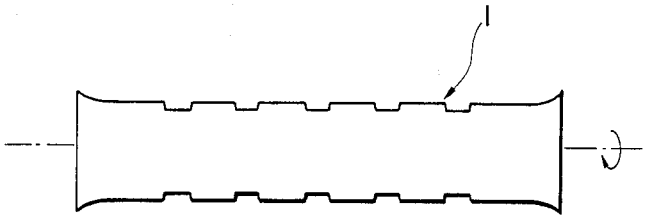
FIG. 6 is a profile of still another abrasive brush which could be used with the apparatus of the present invention.
Figure 7:
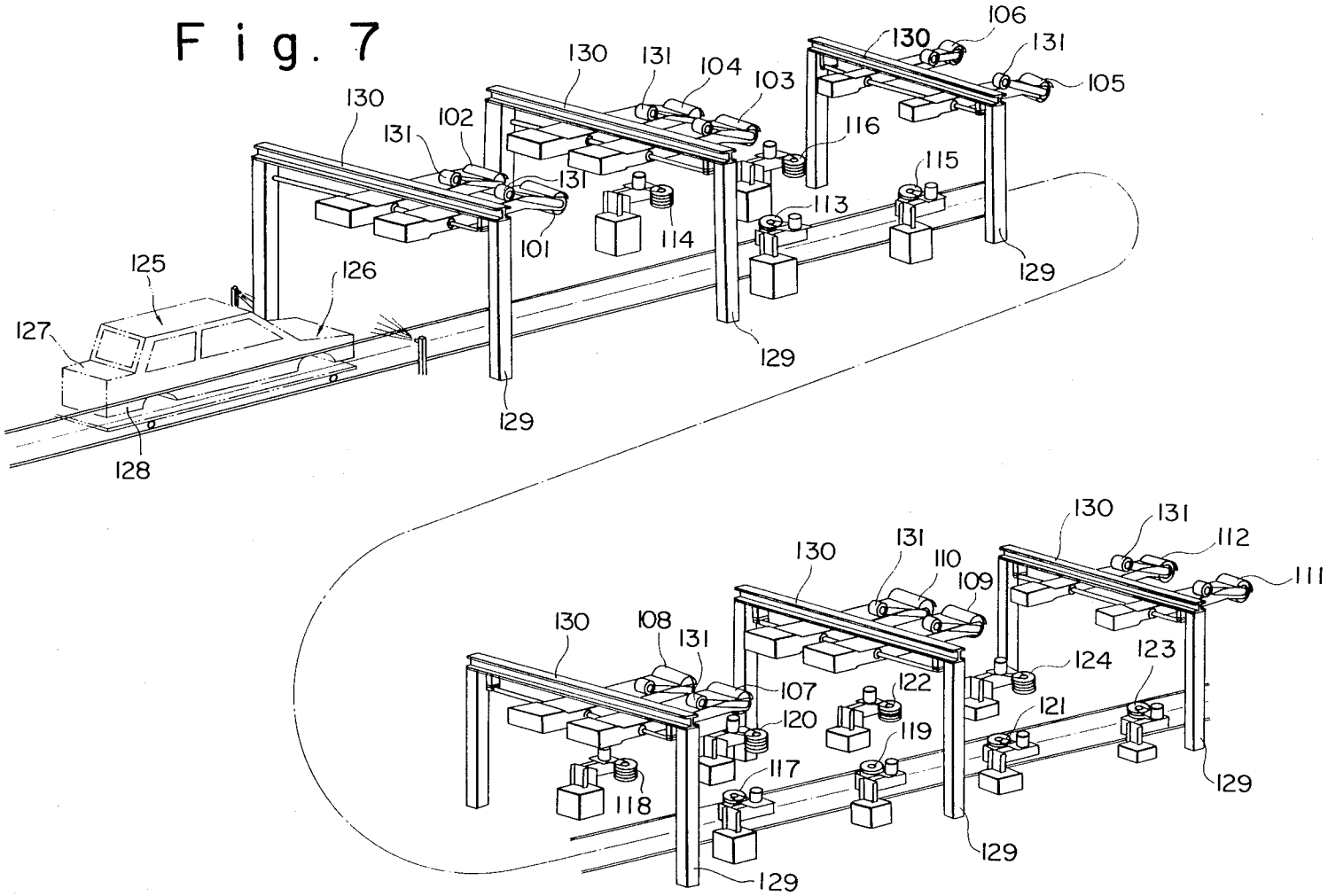
FIG. 7 is a perspective view of one embodiment of the apparatus according to the invention.

As shown in FIG. 7 successive prime coated automobile bodies are moved along a line of conveyance at a constant rate by means of a floor conveyor. The speed of conveyance may be not higher than about 10 m/min. The interval of the adjacent automobile bodies may be set, for example, about 1.0 m. The surfaces of each automobile body are processed by coming in contact with cylindrical abrasive brushes 101, 102, 103, 104, 105, 106, 107, 108, 109, 110, 111, 112, 113, 114, 115, 116, 117, 118, 119, 120, 121, 122, 123, and 124 power driven with their axes of rotation perpendicular to the direction of conveyance of the automobile body. Among these brushes, 101 to 106 are for processing the surface of the roof 125, 107 to 112 are for processing the surfaces of the bonnet 126 and trunk 127, and 113 to 124 are for processing the side surfaces 128 of the automobile body. Alternatively, the apparatus may be designed so that one and the same brush may successively process areas of the bonnet, roof and trunk of each automobile body. An apparatus according to the invention comprises a plurality of abrading units for processing different areas of the upper surfaces of each automobile body, said units being successively disposed in predetermined spaced relation along the line of conveyance of the automobile bodies. The illustrated apparatus comprises six such units.

Figure 8:
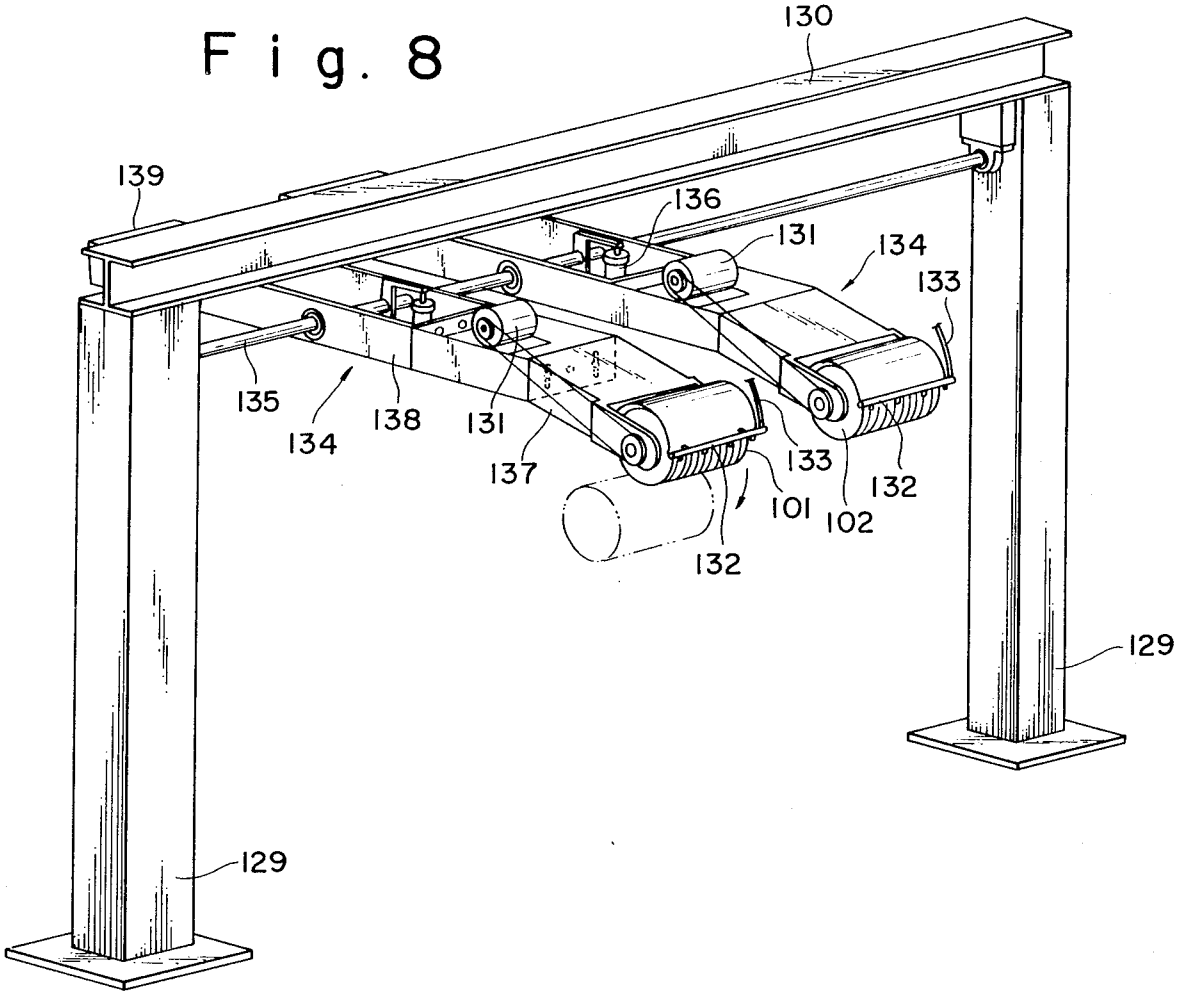
FIG. 8 is a perspective view of one of the units for processing different areas of the upper surfaces of each automobile body.

As shown in FIG. 8, each unit for processing a particular area of the upper surfaces of each automobile body comprises a support structure adjacent the line of conveyance of the automobile bodies. The illustrated support structure is constructed as a gate straddling the line of conveyance of the automobile bodies and composed of a pair of upright posts 129 and an overhead reinforcing beam 130.

The unit further comprises at least one cylindrical abrasive brush rotatable with its axis of rotation in perpendicular to the direction of conveyance of the automobile bodies for processing a particular area of the upper surfaces of each automobile body, and for each brush there is provided an electric motor 131 for the rotation thereof. While the brush may be of a known flap type having radial flexible flaps of nylon with abrasive particles (e.g., of a size of about 300 microns in diameter and about 300 microns in length) bonded thereto, it should have an effective abrasive width less than a half of the width of the upper surfaces of the automobile body and should have a generally cylindrical outer configuration. While all the units illustrated in FIGS. 7 and 8 have a pair of brushes, one of them may be replaced a unit having a single brush for processing a center line of the upper surfaces of the automobile bodies. I have found that satisfactory results are obtainable by using brushes having an effective abrasive width of from about a seventh to about a fourth of the transverse width of the automobile body. The optimum rate of rotation of the brushes is in the order of about 1,000 rpm, but this may be changed by means of pulleys depending upon the rate of conveyance and the nature of the brushes. For the purpose of wet-sanding each brush is provided with a means for spraying water comprising a perforated tube 132 with one end closed and another end connected to a hose 133 communicating a water source.

The unit further comprises a swing arm for rotatably mounting the brush and fixedly securing the motor;

a shaft for rotatably supporting said swing arm at such a position that said shaft can be an axis of any swing motion of the brush mounted on said swing arm;

a member for transmitting the rotating motion of said shaft around its axis to said swing arm, fixed at one end to said shaft and at the other end to said swing arm and having a double acting piston means interposed between said ends;

a brake motor for rotating said shaft and braking the rotation of said shaft;

a means for displacing the piston of said double action piston means so that said brush may be forced against the surface of the automobile body to be processed without rotation of hereinafter said brake means when said brush has come in contact with said surface, and for maintaining the pressure differential so established in said double acting piston means during the processing of said surface;

a clutch means interposed between said brake motor and said shaft;

a brake means for braking the rotation of said shaft only for moment when said brush has come in contact with a surface of the automobile body to be processed; and an encoder connected to said shaft for detecting the amount of rotation of said shaft and dispatching the detected signal for automatic control of the operation of at least said brake motor and double acting piston means.

Figure 9:
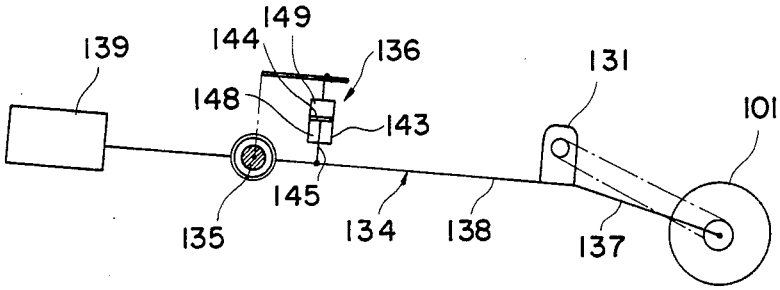
FIG. 9 is a diagrammatic longitudinal vertical cross-sectional view of the swing arm, showing double acting piston means.
Figure 10:
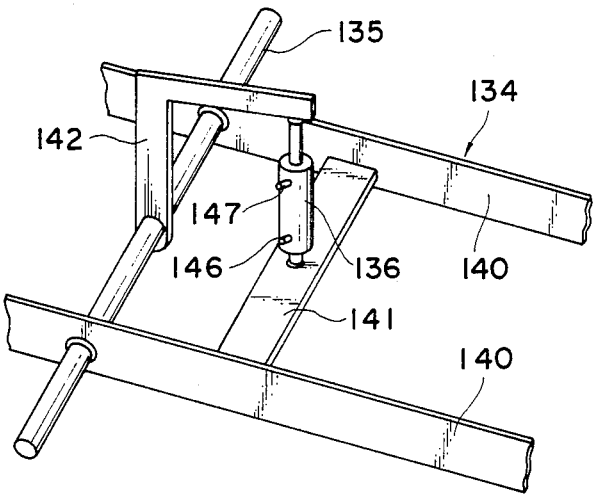
FIG. 10 is a perspective view of a part of the swing arm showing mechanical relations among the swing arm, shaft and double acting piston means.

FIG. 9 is a diagrammatic longitudinal vertical cross-sectional view of the swing arm 134 for illustrating mechanical relations among the swing arm 134, shaft 135 and double acting piston means 136. FIG. 10 is a perspective view of a part of the swing arm for the same purpose.

The swing arm 134 comprises a front member 137 rotatably mounting the brush at its front end, a middle member 138 carrying the motor 131 at its front end and a rear balancing weight 139 fixed at the rear end of the middle member 138. The front member 137 carrying the rotatable brush is screwed to the front end of the middle member in such a manner that the axis of rotation of the brush may be set horizontally or obliquely. The oblique axis of rotation is often desirable for the brushes 105, 106, 111 and 112 (see FIG. 7). The middle member 138 comprises a pair of parallel levers 140 having apertures, and is rotatably supported by a shaft or guide roller 135 passing through the apertures by means of suitable bearings. The shaft must support the swing arm adjacent the center of gravity of all the exerting weights. This structure allows free rotation of the swing arm 134 around the axis of the shaft 135. There is provided a member for transmitting the rotating motion of said shaft around its axis to said swing arm, fixed at one end to said shaft and at the other end to said swing arm and having a double acting piston means interposed between said ends. In the embodiment shown in FIGS. 9 and 10, a piston rod 145 of the double acting piston means 136 is connected to the swing arm 134 via a member 141 bridging the levers 140 of the swing arm, and the opposite end of the double acting piston means 136 is connected to the shaft 135 via an L-shaped member 142 fixed to the shaft 135. The double acting piston means 136 comprises a cylinder 143, a piston 144 reciprocally slidable within the cylinder 143 and a piston rod 145 connected to the piston 144 at one end with the other end connected to the swing arm 134 via the member 141, and is constructed so that air of different pressures may be respectively introduced through air hoses 146 and 147 into spaces 148 and 149 within the cylinder 143 separated by the piston 144.

Figure 11:
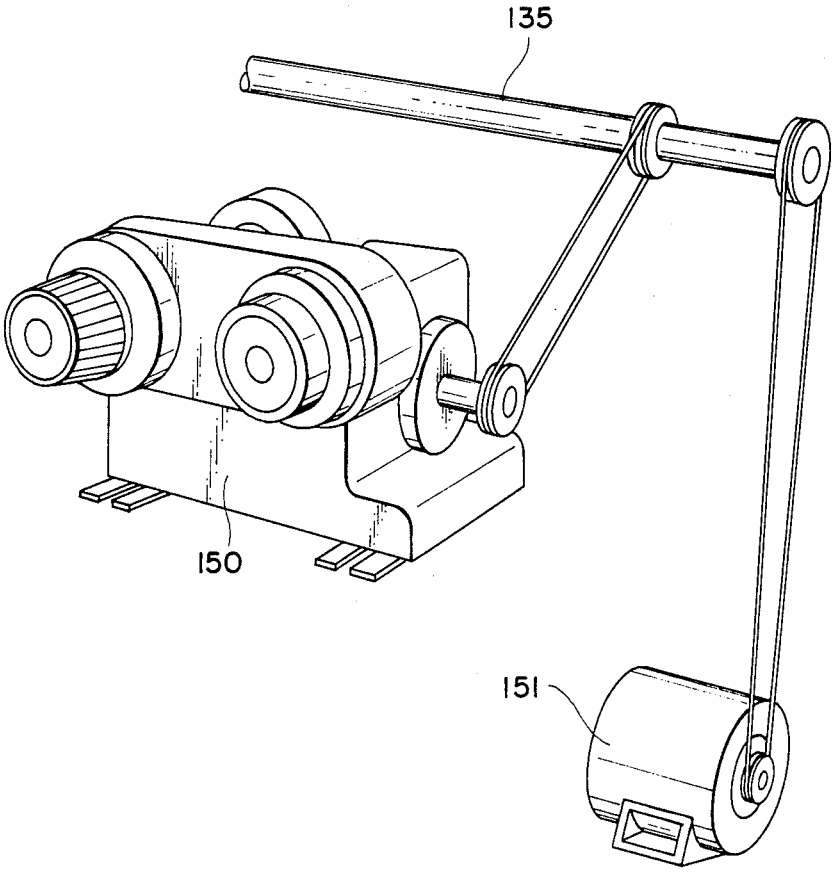
FIG. 11 is a perspective view of a means for rotating and locking the shaft in position.

As shown in FIG. 11, the shaft 135 which carries the swing arms and other elements, and rotatably mounted on the posts 129 of support structure, can be rotated and locked in position by means of a pulley brake motor 150, and the amount of rotation may be detected and memoried by means of a detector or encoder 151. The maximum amount of rotation of the shaft can be, for example, about 50°. The brake motor 150 and detector 151 as well as attachments thereto may be installed within one of the posts 129 of the support structure.

Figure 12:
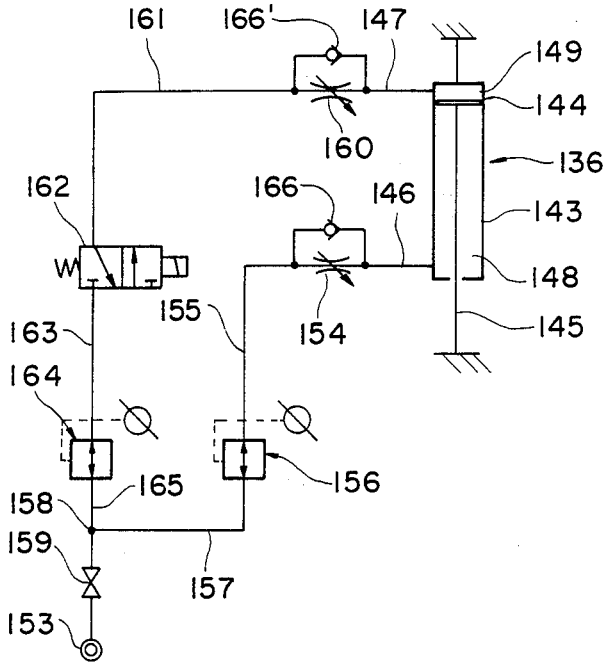
FIG. 12 is a diagrammatic view showing an example of a means or system for maintaining a predetermined constant pressure differential between the spaces within the cylinder of the double acting piston means during operation.

FIG. 12 illustrates a means for preventing variations of the pressure differential between the spaces 148 and 149 within the cylinder 143 of the double acting piston means 136. As shown in FIG. 12, the space 148 of the cylinder 143 communicates with a compressed air source 153 via a conduit 146, speed controller 154, conduit 155, precise pressure reducing valve 156, conduit 157, T-connection 158 and valve 159, while the space 149 communicates with the compressed air source 153 via a conduit 147, speed controller 160, conduit 161, electromagnetic valve 162, conduit 163, precise pressure reducing valve 164, conduit 165, T-connection 158 and valve 159. The speed controller 154 is a squeeze valve having a one way by-path provided with a check valve 166, which allows air to flow through the by-path from the conduit 146 to the conduit 155 but not from the conduit 155 to the conduit 146. When the air pressure in the conduit 155 is higher than that in the conduit 146, the speed controller 154 allows air to flow from the conduit 155 to the conduit 146 at a limited flow rate. Whereas if the pressure in the conduit 146 is higher than that in the conduit 155, air may freely flow from the conduit 146 to the conduit 155 passing through the check valve 166' on the by-path. The speed controller 160 has a similar structure. The precise pressure reducing valve 156 serves to precisely reduce the air pressure in the conduit 157 to a pre-set value of the air pressure in the conduit 155. In the event the air pressure in the conduit 155 exceeds the pre-set value, the valve 156 allows air in the conduit 155 to escape through the valve 156 until the pre-set value of the air pressure is reached in the conduit 155. When the brush is not to be operative air is normally introduced from the compressed air source 153 through the precise pressure reducing valve 156 and spaced controller 154 into the lower pressure chamber 148 whereby the brush is held at its retracted ineffective position. The pressure in the chamber 148 may be set, for example, 1.0 kg/cm$^2$ by means of the valve 156. When the automobile body approaches the brush (the shaft carrying the brush is already in position), the electromagnetic valve 162 is opened by an electric signal, whereupon air is introduced from the source 153 through the precise pressure reducing valve 164, electromagnetic valve 162 and speed controller 160 into the high pressure chamber 149. The pressure in the chamber 149 must be set higher than that in the chamber 148, for example 2.0 kg/cm$^2$, by means of the valve 164. A part of the air thus contracted in the low pressure chamber 148 is allowed to pass through the conduit 146, by path having the check valve 166 and conduit 155 and eventually caused to escape through the valve 156 until the pressure in the chamber 148 reaches the pre-set value (1.0 kg/cm$^2$). The pressure differential so created pushes the rotating brush onto the surface of the automobile body being processed. If the operating brush in contact with the surface of the moving automobile body is pushed back for some reasons, air is caused to flow into the chamber 148 and at the same time a part of the contracted air in the chamber 149 is allowed to pass through the conduit 147, check valve 166' on the by-path of the speed controller, conduit 161, electromagnetic valve 162 and conduit 163, and then caused to escape through the valve 164, whereby the predetermined pressure differential may be maintained. I have found that the pressure differential controlling means described herein well acts in response to a variation of the pressure differential as low as about 0.001 kg/cm$^2$.

Figure 13:
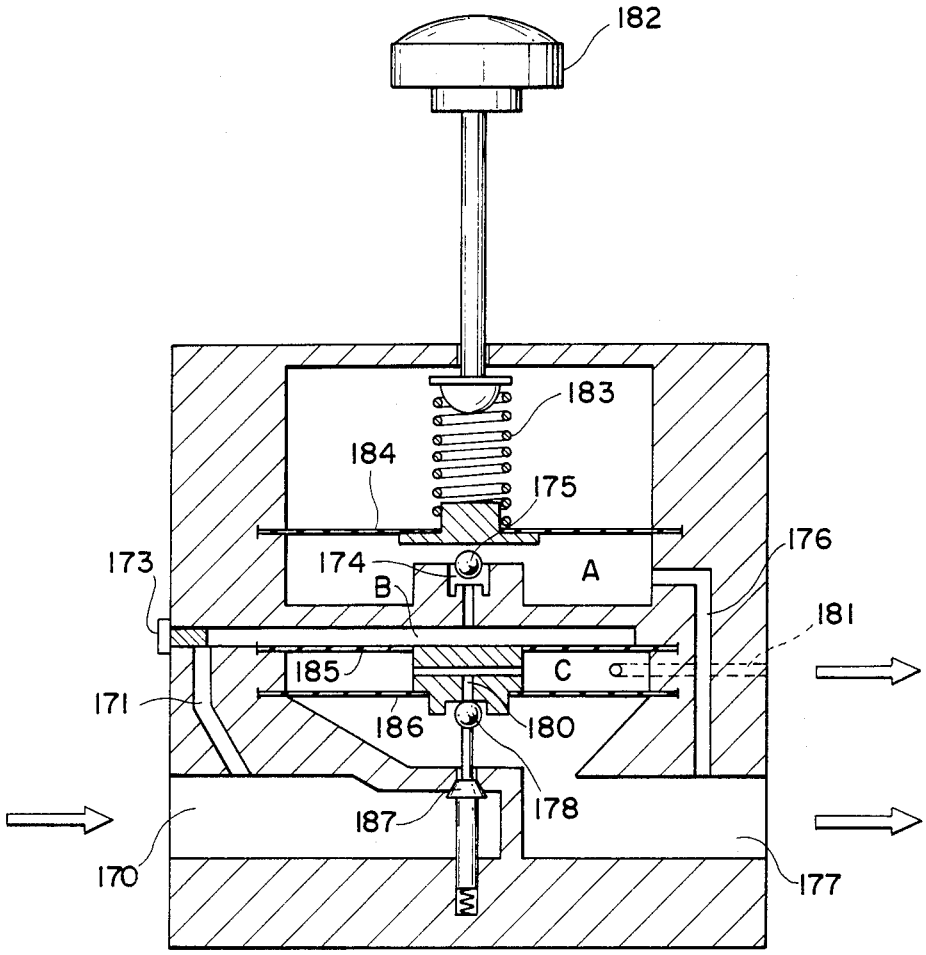
FIG. 13 is a vertical cross-sectional view of an example of the precise pressure reducing valve.

FIG. 13 is a vertical cross-sectional view of an example of the precise pressure reducing valve. While the precise structure of the precise pressure reducing valve is not the subject matter of the invention, the mechanism of the valve will now be described in more detail with reference to FIG. 13.

When compressed air is introduced into the valve at an inlet port 170 without setting any pressure, the air is allowed to pass through a channel 171, a restricted part 172 squeezed by a screw 173, a chamber B, a clearance between a nozzle 174 and flapper, a chamber A, and a channel 176 to an oulet port 177. The squeezing screw 173 serves to adjust the flow rate of air. A part of the air so introduced into the outlet port 177 will be allowed to pass through a clearance between a flapper 178 and exhaust valve 180 and a chamber C, exhausted from the valve through a channel 181.

When a handle 182 is rotated to compress a spring 183 for the purpose of setting a pressure in the outlet port 177 at a certain value, a diaphragm 184 is caused to descend to push down the flapper 175 whereby the nozzle 174 is closed. This causes the pressure in the chamber B to increase, whereby a diaphragm 185 and in turn a diaphragm 186 descend to close the exhaust valve 180, and at the same time a main valve 187 is opened, permitting air to flow from the inlet port 170 through the main valve 187 to the outlet port 177.

When the air pressure in the outlet port 177 exceeds the pre-set value, the same pressure also exercises in the chamber A, which communicates with the outlet port 177 via the channel 176, and causes the diaphragm 184 to ascend. This causes the clearance between the nozzle 174 and flapper 175 to open, whereby a part of the air in the chamber B instantaneously escapes in the chamber A, causing the pressure in the chamber B to decrease. When the air pressure in the chamber B has decreased, the diaphragms 186 and 185 are caused to ascend to open the exhaust valve 180, whereby a part of the air in the outlet port 177 is allowed to exhaust through the exhaust valve, chamber C and exhaust channel 181, at the same time the main valve 187 is close whereby the direct air flow from the inlet port 170 to the outlet port 177 is prevented.

Figure 14:
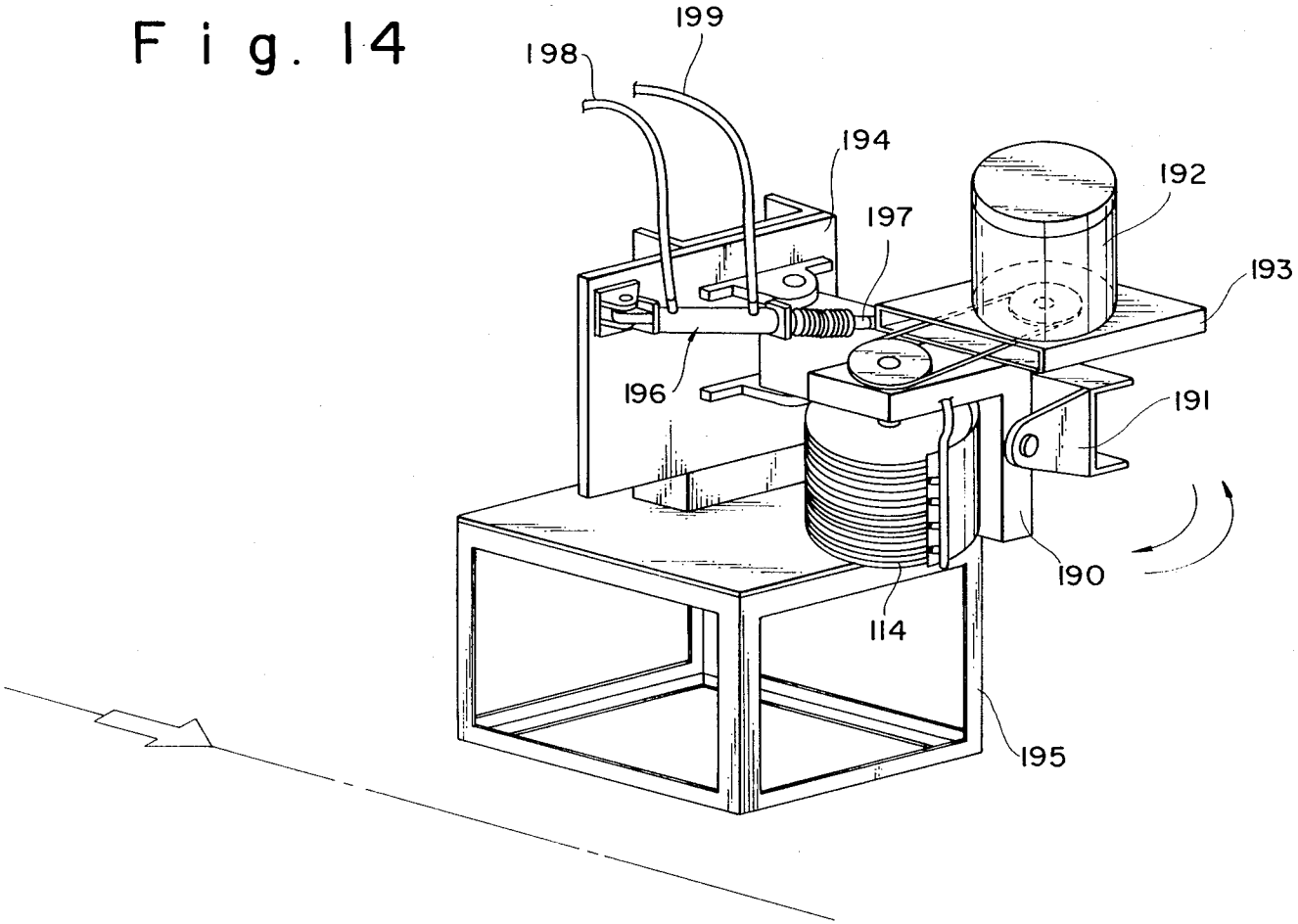
FIG. 14 is a perspective view of one of the units for processing different areas of the side surfaces of each automobile body.

The apparatus according to the invention further comprises a plurality of abrading units for processing different areas of the side surfaces of each automobile body. The apparatus illustrated in FIG. 7 has six pairs of such units. FIG. 14 is a perspective view of one of such unit.

As shown in FIG. 14, a single cylindrical abrasive brush 114 is rotatably supported at the upper end of its axis of rotation on a sleeve 190, which is fixed to an arm 191. An electric motor 192 for rotating the brush 114 is securely mounted on a plate 193 which is also fixed to the arm 191. The arm 191 is pivotably supported by an upright supporting plate 194, which is fixed on a supporting frame base 195. A double acting piston means 196 is pivoted on the supporting plate 194 at one end of the cylinder, and a piston 197 of the double acting piston means 196 is connected to the arm 191 at one end. The double acting piston means 196 has a similar structure to that of the hereinbefore described means 136, and functions similarly. Air of predetermined different pressures are introduced through air hoses 198 and 199 into chambers within the cylinder 196, and the pressure differential between the chambers is controlled in the manner as hereinbefore described with reference to FIGS. 12 and 14. A unit similar to that shown in FIG. 14 is installed on the opposite side of the line of conveyance of the automobile bodies, and this pair of units are operated in synchronism to process particular longitudinal zones of both the side surfaces of the same level of each automobile body. Other pairs of the side units are to process respective particular longitudinal zones of both the side surfaces of different levels.

Figures 15, 16:
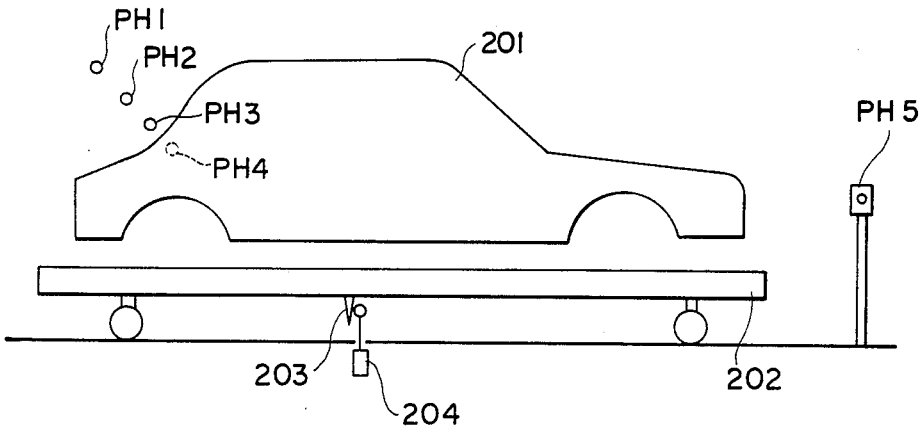
FIG. 15 is a side elevational view of an automobile body just in advance of being conveyed in the wet-sanding line, showing how to detect the model and type of the body.
FIG. 16 is a key for detecting the model or type of an automobile body which is going to be processed.

FIG. 15 is a side elevational view of an automobile body just in advance of being conveyed along the wet-sanding line, showing how to detect the model and type of the body. As shown in FIG. 15, a given automobile body 201 is placed on a platform car 202 and is going to be conveyed along the wet-sanding line according to the invention. When a downwardly extending protrusion 203 on the bottom of the platform car 202 pushes a limit switch 204 on the floor, photo tubes PH1, PH2, PH3 and PH4 are energized, and automatic observation is made as to whether or not the respective photo tubes are shaded by the automobile body. In the case illustrated in FIG. 15, photo tube PH4 is only shaded by the automobile body, while others are not, indicating the body concerned is sedan. FIG. 16 shows a key matrix for determination of the model and type of the automobile body. In FIG. 16, circle marks indicate "not shaded", while cross marks indicate "shaded".

There is provided another photo tube PH5 just (e.g. 500 to 2000 mm) in front of the wet-sanding apparatus. When this photo tube is shaded by the automobile body, a pulse generator (not shown) associated with a driving part of the conveyor is started to generate pulses, for example, at a rate of one pulse per 6 mm of conveyance. Energizing and de-energizing of all the electric and electromagnetic elements included in the wet-sanding apparatus are carried out based on the pulse signals. For example, based on a particular pulse signal, brake motor 150 of a particular top processing unit is energized to rotate shaft 135 and to lock or brake it in position. The amount of rotation of the shaft is detected by detector or encoder 151, and confirmed whether or not the shaft has been brought and held in position. If no, an emergency device (not shown) operates. If yes, motor 131 to rotate the brush is energized, and electromagnetic valve 162 (FIG. 12) is opened whereby air is introduced into the high pressure chamber 149 of cylinder 143 of the double acting piston means 136 to start the processing.

As to operation of a side processing unit shown in FIG. 14, a particular pulse signal energizes the motor 192 for rotating the brush 114, and directly opens an electromagnetic valve (not shown) whereby air is introduced into a high pressure chamber of the cylinder 196 to bring the rotating brush 114 in contact with the surface to be process.

Figure 17:
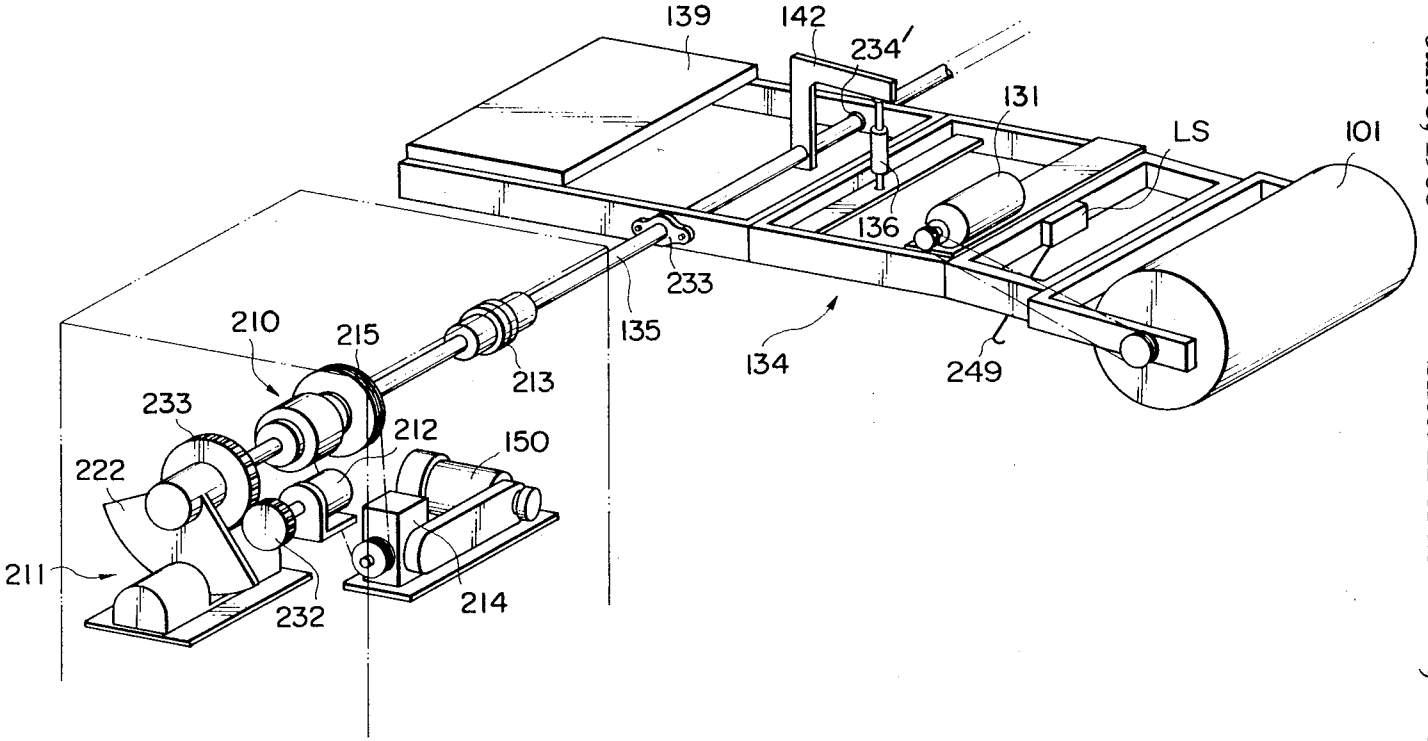
FIG. 17 is a perspective view of the swing arm for illustrating the swinging motion of the arm and a mechanism for controlling the swinging motion.

FIG. 17 illustrates a mechanism for swinging the swing arm 134 and controlling the swinging motion. In the illustrated mechanism, a clutch means 210, a brake means 211 and an encoder 212 for detecting the swing angle (the amount of rotation of the shaft 135), are attached to the shaft 135. The reference numeral 213 designates a sprocket wheel and the reference numeral 150 designates a brake motor rotatable in one and reverse directions, which has been shown in FIG. 11. The rotating force of the brake motor 150 is transmitted via a reduction gear 214 to a pulley 215 of the shaft 135. The pulley 215 is in released engagement with the shaft 135, and the rotating driving force of the pulley 215 is transmitted to the shaft 135 via the clutch means 210.

Figure 18:
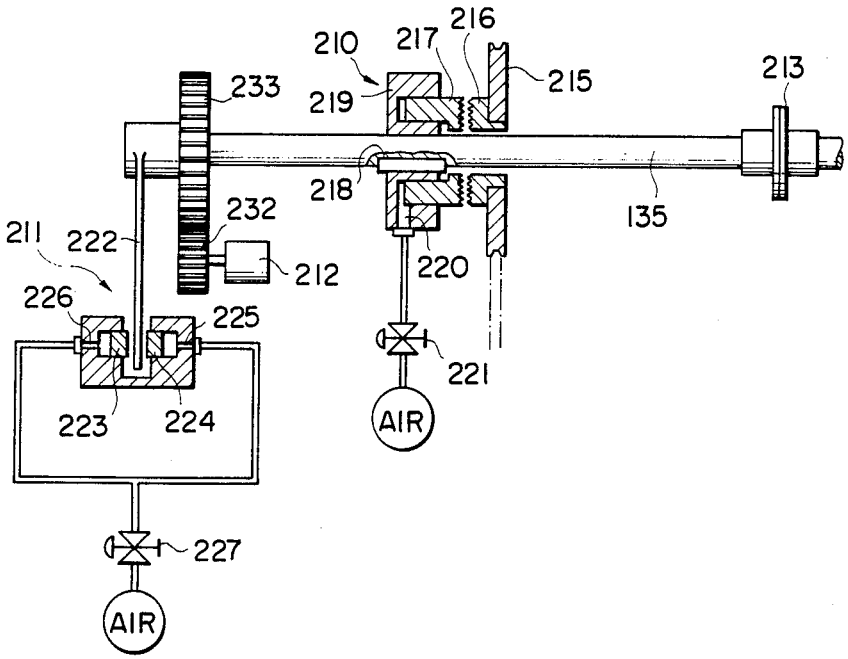
FIG. 18 is a diagrammatic view showing mechanical relations of a clutch means, brake means and gate encoder to the shaft of the swing arm.

As diagrammatically shown in FIG. 18, the clutch means 210 may be a friction air clutch comprising a pulley-side clutch plate 216, which is attached to the pulley 215 and in released engagement with the shaft 135, and a shaft-side clutch plate 217, which is in fixed engagement with the shaft 135 and rotatable together with the shaft 135, constructed so that the shaft-side clutch plate 217 may be inserted into a housing 219, which is fixed to the shaft 135 by means of a key 218, and that the shaft-side clutch plate 217 may be pressed against the pulley-side clutch 216 by compressed air supplied from an air port 220. The reference numeral 221 designates an electromagnetic valve for supplying the compressed air to the air port 220 and releasing it from the air port 220 into the ambient atmosphere. The shaft-side clutch plate 217 is activated by a spring (not shown) so that the clutching may be released when the compressed air in the air port 220 is released into the ambient atmosphere. Further, the friction between the clutch plates 216 and 217 is appropriately preset so that if an emergency has happened at the driven side (the shaft side), for example, if the rotation of the shaft has been prevented by an obstacle, at the time clutch plates 216 and 217 are in clutching engagement, the plates may slide so as to cause the rotation force of the driving side to escape.

As diagrammatically shown in FIG. 18, the brake means 211 may be an air brake comprising a disc 222 fixed to the shaft 135 and air-driven controlling elements 223 and 224 for clamping the disc 222 to prevent its rotation. The reference numeral 225 and 226 designate air ports for supplying compressed air, and the reference numeral 227 designates an electromagnetic valve for supplying the compressed air to the air ports 225 and 226 and for releasing the compressed air therefrom to the ambient atmosphere. Each controlling element 223 or 224 is activated by a spring (not shown) so that it may be brought to a position of out of contact with the disc 222 to release the braking. The brake means 211 may restrain the rotation of the shaft 135 so that the swing arm 134 may take any angular inclination ranging from horizontal position to about 50° inclination. The brake means serves to eliminate or reduce any undesirable inertia involved in the rotating (swinging) motion of the swing arm 134 as well as inadvertent rebounding of the arm 134 on the surface of the automobile body which might be caused by counteraction of the rotation of the abrasive brush 101 at the time the rotating brush 101 comes in contact with the surface of the automobile body. In order to increase the operating line speed of the abrading apparatus and to realize uniform abrasion it is important to eliminate or reduce the above-mentioned undesirable inertia and inadvertent rebounding of the swing arm 134. Instead of the illustrated air brake an electromagnetic brake in which controlling elements are driven by an electromagnet may also be used as the brake means 211.

Figure 19:
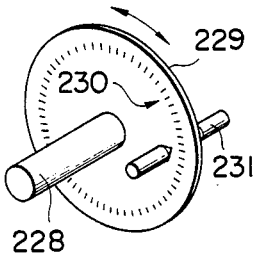
FIG. 19 is a view for illustrating a principle of the gate encoder.

The encoder 212 for detecting the amount of rotation of the shaft 135 (the swing angle of the swing arm 134) utilizes a photo tube which may convert the angle of rotation of the shaft 135 to a pulse signal. The principle of this encoder is shown in FIG. 19. The encoder 212 comprises an axis 228, a disc 229, which is rotatable together with the axis 228 and provided with a plurality of slits 230 circumferentially located with the same intervals, and a photo tube 231 for dispatching a signal of pulses, the number of said pulses corresponding to the number of slits 230 through which light has been transmitted upon rotation of the disc 229. Thus, the amount of rotation of the shaft 135 can be given by the number of pulses. To the axis 228 of the encoder 212 rotation of the shaft 135 is transmitted via gears 232 and 233 (see FIGS. 17 and 18). Since the pulley-side clutch plate 216, at the driving side of the clutch means 210, is in disengagement with the shaft 135, the amount of rotation of the shaft 135 detected by the encoder 212 is not affected by the angular displacement of the pulley 215 or brake motor 150. As already described with reference to FIGS. 9 and 10, the swing arm 134 is freely rotatably supported by the shaft 135 via bearings 234 and 234', and the rotation of the swing arm 134 around the shaft 135 is limited by means of the L-shaped member 142 and the double acting piston means 136. When the space 149 (FIG. 12) in the piston 143 of the double acting piston means 136 is pressurized, the swing arm 134 swings to a certain extent with no rotation of the shaft 135. However, this extent of swinging of the swing arm 134 is not detected by the encoder 212, since the shaft 135 does not rotate.

As described hereinabove, the swing arm 134 is supported at a position near the center of the gravity of all the exerting weights by bearings 234 and 234' so that it may freely rotate around the shaft 135. More precisely, the swing arm 134 is supported at such a position near the center of the gravity of all the exerting weights that the weights on the side of the rear balancing weight member 139 are slightly larger than the weights of the side of the brush 101, whereby whenever the control of the brake means 211 is released and the clutch means 210 is brought in non-clutching condition the swing arm 134 may come to the horizontal condition by itself from whatever position of inclination it has taken. The swing arm 134 maintains the horizontal condition unless any motive force is applied thereto. The beam 130 (FIG. 8) is provided with a stopper (not shown) for limiting the uppermost position of the brush 101 so that the swing arm may comes to the horizontal condition when its brush-side is allowed to rise.

The swinging motion of the swing arm 134 and the abrading operation of the brush 101 will now be described with reference to FIG. 20.

Figure 20:
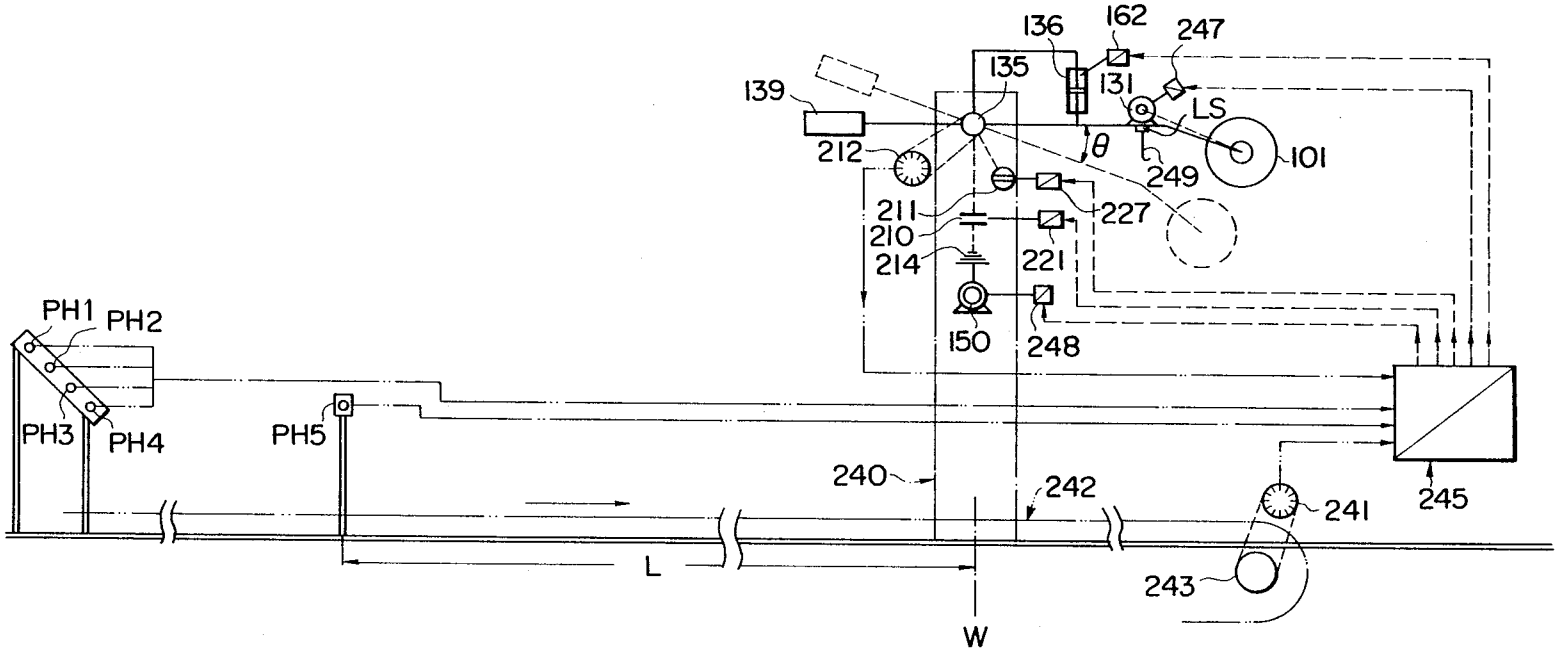
FIG. 20 is a diagrammatic side view of the gate for illustrating the abrading operation at said gate.

FIG. 20 is to illustrate the abrading operation at a unit or gate 240 disposed at a location spaced by a distance of L from a photo tube switch PH5 for detecting the approach of the automobile body. It will be appreciated that a similar abrading operation to that at the gate 240 may be performed at other gates. Each brush has an effective abrasive width less than a half of the width of the upper surfaces of the automobile body, typically of from about seventh to about fourth of the width of the upper surfaces of the automobile body, and is intended to successively process the bonnet (a), roof (c) and trunk (e) of the automobile body (see FIG. 21) with its effective abrasive width.

In FIG. 20, PH5 designates a transmitting or reflective photo tube switch, which is located upstream of the first gate along the abrasive line, spaced apart by a predetermined distance from said first gate, for detecting the front end of the automobile body entering the line. PH1 to PH4 are photo tubes for detecting the model or type of the automobile body which is to be processed, as described hereinbefore with reference to FIGS. 15 and 16. The reference numeral 249 designates a tactile element or lever connected to a limit switch LS (see FIG. 17) mounted on the swing arm 134. When the element 249 has detected something wrong, for example, the bonnet being opened or the presence of an alien body on the automobile body, the limit switch is operated so that the clutch means 210 may be deactuated so as to bring the swing arm 134 to its horizontal condition. The reference numeral 241 designates an encoder mounted on a driving part 243 of a conveyor belt 242, which is driven at a predetermined constant speed, for indicating the location of a particular automobile body being conveyed along the line. This encoder 241, hereinafter referred to as a conveyor encoder, is incremental, while the hereinbefore described encoder 212 for detecting the amount of rotation of the shaft 135 is absolute. The latter encoder 212 will be hereinafter referred to as a gate encoder. The conveyor encoder 241 is set so that it may dispath dispatch one pulse as the conveyor progresses by a predetermined distance, e.g., 6 mm. The reference numeral 245 designates a controlling computer.

Detection parts for automatic control include the PH1 to PH4, PH5, LS, conveyor encoder 241 and gate encoder 212. Signals detected by the detection parts are put in the computer 245, where calculation of the detected signals and comparison of the results with stocked data are peformed, and control signals are put out to operation parts of the apparatus according to the invention. The operation parts include an on-off magnet switch 247 of the motor 131 for rotating the brush 101, the electromagnetic valve 162 (FIG. 12) for supplying compressed air into the space 149 of the cylinder 143 in the double acting piston means 136 (this motion, supply of compressed air into the space 149, will be hereinafter referred to as pressurization of the abrasive brush), an on-off magnet switch 248 of the brake motor 150, the electromagentic valve 221 (FIG. 18) for actuating the clutch means 210, and the electromagnetic valve 227 for actuating the brake means 211.

Setting of the working level or vertical position of the abrasive brush 101, movement of the brush and pressurization of the brush after it has come in contact with the surface to be processed, are carried out depending upon the model and type as well as the particular part (bonnet, roof or trunk) and zone (middle or edge of the width) of the upper surfaces of the body which is about to be processed. Typical basic motions of the apparatus at one gate are as follows.

(1). Condition immediately before operation where the swing arm remains horizontal The motor 150 is stopped, and the electromagnetic valves 221 and 227 are operated so that the compressed air may be released from the clutch means 210 and brake means 211, respectively. There is no clutching and braking in this condition, and the swing arm 134 is freely rotatable around the shaft 135 and balanced by the rear balancing weight 139, taking its horizontal position. The motor 131 for driving the brush 101 is not rotating.

First of all the clutch means 210 is actuated by operating the electromagnetic valve 221 in accordance with a start-up signal so that air may be supplied to the clutch means 210.

(2). Descending motion of the brush

When PH5 has detected the entry of the automobile body, the motor 131 for rotating the brush 101 is started to rotate and the motor 150 is also caused to rotate. The rotating force of the motor 150 is transmitted to the shaft 135. As a result, the swing arm 134 begins to swing to cause the brush 101 to descend.

(3). Stopping of the descending motion of the brush

When the swing arm 134 has swung to cause the brush 101 to descend to a preset level (when the amount of rotation detected by the gate encoder 212 has reached a preset value), the motor 150 is caused to stop rotating. The motor 150 is a brake motor designed so that its rotor may be electromagnetically locked where it has stopped rotating. However, it is difficult to bring the abrasive brush 101 exactly to the desired level. This is partly because a slight lag is unavoidably involved in the transmission of the rotating force, and partly because the braking power of the brake motor alone is insufficient to completely absorb an inertia involved in the swinging motion of the swing arm 134 as well as inadvertent rebounding of the arm 134 which might be caused by counteraction of the rotation of the abrasive brush 101 at the time the rotating brush 101 comes in contact with the surface of the automobile body. For this reason, I utilize, in addition to the electromagentic braking by means of the brake motor 150, mechanical braking by the brake means 211. Thus, when the motor 150 has stopped, the electromagnetic valve 227 is operated to effect the mechanical braking by the brake means 211. At the time the above-mentioned inertia and inadvertent rebounding of the swing arm 134 have disappeared (normally about 2 seconds after the abrasive brush 101 has come in contact with the surface of the automobile body to be processed), the electromagnetic valve 227 is operated so that the air may be released from the brake means 211 thereby to release the mechanical braking. Obviously, it is impossible under the mechanically braked condition to control the abrading process so that the abrasive pressure may be maintained constant irrespective of some changes of the surface configurations of the automobile body being processed.

(4). Pressurization of the abrasive brush

As long as the abrasive brush 101 is operating in contact with the upper surface of the automobile body, the electromagnetic valve 162 is kept open so as to supply compressed air to the cylinder 143 of the double acting piston means 136, whereby the abrasive brush 101 is pressurized.

(5). Changes of the level of the brush

The apparatus according to the invention may be designed so that a particular brush 101 of a particular gate 240 may process only a single particular part (bonnet, roof or trunk) of the body, or it may be designed so that a particular brush may successively process different parts of the body. In the latter case, the ascending motion of the brush 101 from the working level (a) to (c) as shown in FIG. 21, and the descending motion of the brush 101 from the working level (c) to (e) are concerned. The ascending of the brush 101 from the level (a) to (c) is carried out by effecting reverse rotation of the motor 150, while the descending of the brush 101 from the level (c) to (e) is carried out by effecting normal rotation of the motor 150. In both cases, after the motor 150 has been rotated by the required extent, the above-mentioned procedures (2) to (4) are followed. If desired, the level of the brush 101 may also be controlled during the processing of the part (a) or (e) in accordance with the change of the surface of the part being processed by driving the motor 150 on the basis of the information stored in the computer 245 about the nature of the surfaces of the part (a) and (e) as well as in accordance with the detected signals from the encoders so that a necessary amount of rotation may be given to the shaft 135. The parts (b) and (d), where windows are to be provided, are not processed by the apparatus according to the invention.

(6). Finish

The brake motor 150 is driven so that the swing arm 134 may return to the horizontal condition, and the motor 130 for rotating the brush 101 is switched off to stop the rotation of the brush. The electromagnetic valve 221 is operated so that air may be released from the clutch means 210 into the ambient atmosphere, whereby the clutching is released.

In addition to the above-mentioned basic motions, when the element 249 has detected something wrong, the limit switch is operated so that the clutch means 210 may be deactuated so as to bring the swing arm 134 to its horizontal condition. Further, if the rotation of the shaft has been prevented by an obstacle, at the time the clutch plates 216 and 217 are in clutching engagement, the plates may slide so as to cause the rotating force of the motor 150 to escape. In the latter case, since the gate encoder 212 detects the amount (angle) of rotation of the shaft 135 at the driven side, the read out value of the encoder 212 is not affected by the amount of rotation at the driving side.

FIGS. 22*a* and 22*b* show a flow of automatic control of motions carried out at one gate for processing a body as shown in FIG. 21. An illustrative automatic control of motions at the gate 240 will now be briefly described with reference to FIGS. 21, 22*a* and 22*b*.

Input of A and output of B': When PH5 detects the entry of the automobile body, an output signal for switching the magnet switch 247 of the motor 131 for rotating the brush 101 on is dispatched.

Input of C': Let the distance from PH5 to the gate 240 (see FIG. 20) be L, and suppose that one pulse of the conveyor encoder 241 corresponds to a distance of conveyance of the conveyor of d. It will now be appreciated that when the conveyor encoder 241 has counted L/d pulses after the entry of the body detected by PH5, the body has arrived at the gate 240. This value of L/d is memorized in the computer 245, and compared with the input number of pulses dispatched from the conveyor encoder 241. The coincidence of the input value with the memorized value indicates the arrival of the body at the gate 240.

Reading out of D and E'. As an example processing of the body shown in FIG. 21 will be illustrated. In FIG. 21, W designates the location of the gate 240 (more precisely, the location of the shaft 135), and Z designates the location of the axis of the working brush 101. The longitudinal distances from Z to the respective points indicated in FIG. 21 at the time the front end of the body has reached W, $l_0$–$l_5$, are converted to the values of the conveyor encoder 241 that is in terms of the number of pulses, and memorized in the computer 245. The amounts of rotation of the swing arm 134 necessary for the swing arm to rotate from the horizontal condition to a position suitable for processing the areas indicated in FIG. 21, $\theta_0$-$\theta_5$ are converted to the values of the gate encoder 212 that is in terms of the number of pulses, and memorized in the computer 245. Also memorized in the computer 245 are data as to whether or not the abrasive treatment is carried out on respective areas (a) to (e) of the upper surfaces of the body, $S_0$-$S_5$, $S_n=0$ indicating no abrasion treatment, while $S_n=1$ indicates carrying out the abrasion treatment. Whenever a body has arrived at W, the memorized values are read out and compared with input signals from the conveyor and gate encoders 241 and 212, and control motions are carried out as follows.

First, the body has arrived at the gate, n is set as 0 and the memorized values concerning n=0 are read out. The swing arm 134 is rotated so that the brush 101 may descend until the memorized value $\theta_0$ coincides with the input value from the gate encoder 212 (I of FIG. 22*b*). When the motor 150 has rotated the shaft 135 so that the memorized value $\theta_0$ may coincides with the input value from the gate encoder 212 the swing motion of the swing arm to cause the brush to descend is stopped. That is the motor 150 is stopped rotating and electromagnetically braked (K of FIG. 22*b*). At the same time the brake means 211 is actuated for a moment, for example, for 2 seconds, and then released (L of FIG. 22*b*). By this mechanical braking for a very short period of time undesirably inertia and inadvertent rebounding of the swing arm 134 may be eliminated or reduced to a great extent. The memorized $S_n$ is read out and judged whether it is 1 or 0 (M of FIG. 22*b*). If $S_n$ is 1, the electromagnetic valve 162 is operated so that compressed air may be introduced into the space 149 so as to force the brush 101 against the surface of the body, which is about to be processed (0 of FIG. 22*b*). Comparison of the input value from the conveyor encoder 241 with the memorized value $l_0$ is continued, and when both the values coincide with each other, n is now set as 1, and the memorized values concerning n=1 are read out (R of FIG. 22*b*), and necessary motions are carried out in the manner as described above. The procedures are repeated, and when n exceeds 5, the swing arm 134 is returned to the horizontal condition.

What is claimed is:

1. An apparatus for abrasively treating the surfaces of a series of automobile bodies being longitudinally conveyed along a line by bringing the surfaces of each automobile body in contact with a plurality of abrasive brushes rotating with their axes of rotation perpendicular to the direction of conveyance of the automobile bodies, the improvement which comprises a plurality of abrading units for processing different areas of the upper surfaces of each automobile body successively disposed in predetermined spaced relation along the line of conveyance of the automobile bodies, each of said units comprising:

a support structure adjacent the line of conveyance of the automobile bodies;

at least one cylindrical abrasive brush rotatable with its axis of rotation perpendicular to the direction of conveyance of the automobile bodies for processing a particular area of the upper surfaces of each automobile body, said brush having an effective abrasive width less than a half of the width of the upper surface of the automobile body;

an electric motor for rotating the axis of said brush;

a swing arm for rotatably mounting said brush and fixedly securing said motor;

a shaft for rotatably supporting said swing arm at such a position that said shaft can be an axis of any swing motion of the brush mounted on said swing arm;

a member for transmitting the rotating motion of said shaft around its axis to said swing arm, fixed at one end to said shaft and at the other other end to said swing arm and having a double acting piston means interposed between said ends;

a brake motor for rotating said shaft and braking the rotation of said shaft;

a means for displacing the piston of said double action piston means so that said brush may be forced against the surface of the automobile body to be processed without rotation of said shaft when said brush has come in contact with said surface, and for maintaining a pressure differential so established in said double acting piston means during the processing of said surface;

a clutch means interposed between said brake motor and said shaft;

a brake means for braking the rotation of said shaft only for a moment when said brush has come in contact with a surface of the automobile body to be processed; and an encoder connected to said shaft for detecting the amount of rotation of said shaft and dispatching a signal representative of the amount of rotation of said shaft which has been detected for automatic control of the operation of at least said brake motor and double acting piston means.

* * * * *